US012644235B2

(12) United States Patent
Burger

(10) Patent No.: US 12,644,235 B2
(45) Date of Patent: Jun. 2, 2026

(54) WORK VEHICLE DISPLAY WITH COMPACTION MONITORING

(71) Applicant: CATERPILLAR PAVING PRODUCTS INC., Brooklyn Park, MN (US)

(72) Inventor: Tyler Burger, North Plymouth, MN (US)

(73) Assignee: CATERPILLAR PAVING PRODUCTS INC., Brooklyn Park, MN (US)

( * ) Notice: Subject to any disclaimer, the term of this patent is extended or adjusted under 35 U.S.C. 154(b) by 46 days.

(21) Appl. No.: 18/936,035

(22) Filed: Nov. 4, 2024

(65) Prior Publication Data

US 2026/0125859 A1 May 7, 2026

(51) Int. Cl.
*E01C 19/28* (2006.01)

(52) U.S. Cl.
CPC ..... *E01C 19/288* (2013.01)

(58) Field of Classification Search
CPC ..... E01C 19/288
USPC ..... 701/50
See application file for complete search history.

(56) References Cited

U.S. PATENT DOCUMENTS 6,244,102 B1 * 6/2001 Novak ..... E01C 19/288 73/78
7,623,951 B2 11/2009 Congdon et al.
8,116,950 B2 2/2012 Glee
2007/0150147 A1 6/2007 Rasmussen et al.
2011/0302998 A1 * 12/2011 Hanson ..... E01C 19/288 73/78
2022/0042253 A1 * 2/2022 Nagel ..... E01C 21/00
2023/0220645 A1 * 7/2023 Doy ..... E01C 19/282 404/133.05
2023/0287638 A1 9/2023 Nagel

FOREIGN PATENT DOCUMENTS

JP 3778939 B2 * 5/2006 ..... E01C 19/288

OTHER PUBLICATIONS

Kim, Use of Dynamic Cone Penetration and Clegg Hammer Tests for Quality Control of Roadway Compaction and Construction, Apr. 2010, INDOT Research (Year: 2010).*
Fratta, Effective Depth of Soil Compaction in Relation to Applied Compactive Energy, Feb. 2015, University of Wisconsin-Madison, (Year: 2015).*

* cited by examiner

*Primary Examiner* — Matthias S Weisfeld

(57) ABSTRACT

A system for controlling compaction operations may receive, from one or more sensors associated with a machine performing compaction operations on earthen materials, sensor data indicating a compaction level. The system may determine, during the compaction operations, a compaction level of the earthen materials based on the received sensor data. Further, the system may receive, via an input device on the machine, a first user input indicating an acceptable compaction range. The system may display, via a gauge on a display screen, the determined compaction level and the acceptable compaction range. Further, the system may receive a second user input associated with at least one operating parameter of the machine in response to the determined compaction level being outside the acceptable compaction range. The system may adjust the at least one operating parameter based on the received second user input.

21 Claims, 9 Drawing Sheets

WORK VEHICLE DISPLAY WITH COMPACTION MONITORING

TECHNICAL FIELD

The present disclosure relates generally to a work vehicle display, and more particularly, to a work vehicle display with compaction monitoring.

BACKGROUND

The compaction of asphalt, dirt, sand, rock, and other earthen material is an important step in the construction of road beds, pavements, foundations, dams, runways, landfill liners, etc. Compaction can improve the load bearing capacity of earthen materials, their strength, and their resistance to failure.

Depending on the type of compaction material used and the construction requirements, different compaction levels may be desired. As a machine compacts the material, a level of compaction will approach the desired compaction level. A display interface may help an operator of the machine monitor the level of compaction and make determinations on next steps in the compaction process.

U.S. Patent Application Publication US 2023/0287638 A1 ("the '638 publication") published Sep. 14, 2023 and discloses a module configured to receive the compaction value and display and/or indicate the compaction value to a machine operator and/or a site manager. The module can activate an indicator (e.g., a green light) in the cab of the compactor to indicate that the current location is sufficiently compacted. In addition to the displayed compaction value, it may be helpful to provide additional information to the machine operator during the compaction operations.

The compaction monitoring and display of the present disclosure solves one or more problems of the prior art.

SUMMARY

In one aspect, the present disclosure is directed to a system for controlling compaction operations. The system may receive, from one or more sensors associated with a machine performing compaction operations on earthen materials, sensor data indicating a compaction level. The system may determine, during the compaction operations, a compaction level of the earthen materials based on the received sensor data. Further, the system may receive, via an input device on the machine, a first user input indicating an acceptable compaction range. The system may display, via a gauge on a display screen, the determined compaction level and the acceptable compaction range. Further, the system may receive a second user input associated with at least one operating parameter of the machine in response to the determined compaction level being outside the acceptable compaction range. The system may adjust the at least one operating parameter based on the received second user input In another aspect, the present disclosure is directed to a method for controlling compaction operations. The method may include receiving, from one or more sensors associated with a machine performing compaction operations on earthen materials, sensor data indicating a compaction level. The method may include determining, during the compaction operations, a compaction level of the earthen materials based on the received sensor data. Further, the method may include receiving, via an input device on the machine, a first user input indicating an acceptable compaction range. The method may include displaying, via a gauge on a display screen, the determined compaction level and the acceptable compaction range. Further, the method may include receiving a second user input associated with at least one operating parameter of the machine in response to the determined compaction level being outside the acceptable compaction range. The method may include adjusting the at least one operating parameter based on the received second user input

DETAILED DESCRIPTION

Figure 1:
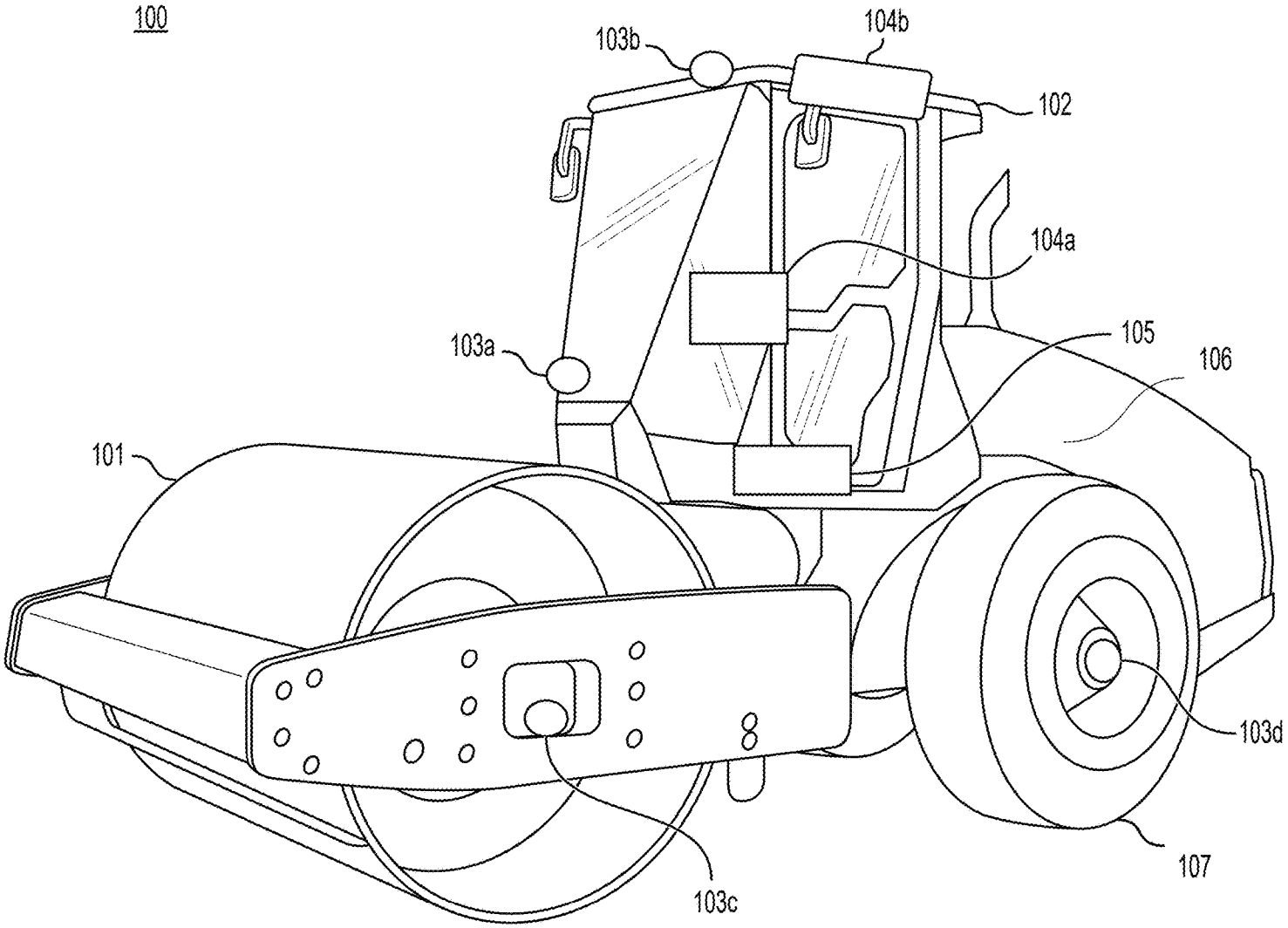
FIG. 1 is an illustration of an exemplary embodiment of a machine.

FIG. 1 illustrates an exemplary embodiment of a compactor machine 100. Compactor machine 100 may represent a variety of different types of compactors. For example, compactor machine 100 may comprise a single drum vibratory roller, dual drum vibratory roller, smooth wheel roller, static roller, multi-tire pneumatic roller, sheepsfoot roller, padfoot roller, grid roller, or track roller. In some embodiments, compactor machine 100 may comprise a hand-operated compactor, such as vibratory tamper, power rammer, or vibrating plate compactor. Compactor machine 100 may include a roller component 101 which uses vibration, impact, and/or pressure to compact the earthen material. For example, roller component 100 may include a vibrating drum to compact the earthen material.

Compactor machine 100 may include a chassis 106 to support components of compactor machine 100, a cabin 102 where an operator may reside and which may be supported by chassis 106, and wheels 107 which may be connected to chassis 106. A first display device 104(*a*) may be mounted inside cabin 102 and visible to the operator. First display device 104(*a*) may include one or more user input devices. For example, first display device 104(*a*) may include buttons, knobs, sliders, and/or display screen elements (e.g., GUI elements). First display device 104(*a*) may further include one or more user output devices. For example, first display device 104(*a*) may include one or more display screens, speakers, and/or lights.

Additionally or alternatively, in some exemplary embodiments, compactor machine 100 may include a second display device 104(*b*). Second display device 104(*b*) may be mounted to the exterior of cabin 102 and/or to another part of the compactor machine 100. Second display device 104(*b*) may include one or more output devices, such as a speakers, display screens, and/or lights.

Compactor machine 100 may further include a plurality of sensors to detect a compaction level. For example, compactor machine 100 may include inclinometer or angle sensor 103(*a*) to detect a slope of the ground and GPS sensor 103(*b*) to detect a position of the compactor machine 100. Compactor machine 100 may include roller sensor 103(*c*), such as a motor current sensor, rotation sensor, position sensor, and/or accelerometer to detect a state of roller 101. Compactor machine 100 may include a wheel sensor 103(*d*) to detect a drive motor current, wheel pressure, wheel speed, and/or torque. Compactor machine 100 may include any other sensor to detect a compaction level of the earthen material.

Compactor machine 100 may further include a system 105 (e.g., a computer system), including one or more processors (e.g. a programmable logic controller (PLC), a CPU, an APU, a microprocessor, a microcontroller, a DSP, an FPGA, an ASIC, or another type of processing component) and one or more memory devices (e.g., non-transitory machine-readable medium, RAM, ROM, flash memory, magnetic storage, optical storage, or another memory device). The one or more memory devices may include a memory device storing instructions to be executed by the one or more processors. System 105 may be mounted inside or outside the body of compactor machine 100. System 105 may be configured to receive data from one or more of sensors 103(*a*)-103(*d*) and determine a compaction level. System 105 may reference one or more lookup tables, models, and/or algorithms that correlate sensor measurements to a compaction level based on a type of compactor machine 100 (e.g., as determined through simulations and/or experimental data). For example, system 105 may determine a compaction level based on a drive motor current and a ground slope angle, as detailed in US 2023/0287638 A1 incorporated herein by reference in its entirety. For example, system 105 may determine a compaction level by monitoring an amount of energy transferred or consumed when compactor machine 100 moves over the earthen material, as detailed in U.S. Pat. No. 6,973,821 B2 incorporated herein by reference in its entirety. For example, system 105 may determine a compaction level by correlating movement(s) of roller 101 (e.g., measured with accelerometer 103*c*) with compaction level(s). System 105 may further be configured to determine an acceptable range of compaction based on compaction setting information and provide additional detail on the determined compaction level relative to the acceptable range as further detailed below. Although the above description references a compactor machine, it is contemplated that the disclosed devices, systems, and methods may be used with any other machine configured to perform compaction operations.

Compactor machine 100 may further include one or more input devices (not shown) to control an operating parameter of compactor machine 100 and adjust a provided compaction. For example, compactor machine 100 may include input devices to adjust a trajectory of compactor machine 100, a speed of compactor machine 100, a speed of roller component 101, a vibration frequency of roller component 101, and/or an amplitude of roller component 101. Input devices may include a wheel, brake(s), lever(s), button(s), knob(s), slider(s), and/or display screen element(s) to adjust one or more operating parameters.

In some embodiments, compactor machine 100 may include a control system to automatically adjust operating parameter(s) of compactor machine 100. The control system may be included in system 105 or it may be separate from system 105. The control system may include one or more processors (e.g. a programmable logic controller (PLC), a CPU, an APU, a microprocessor, a microcontroller, a DSP, an FPGA, an ASIC, or another type of processing component) and one or more memory devices (e.g., non-transitory machine-readable medium, RAM, ROM, flash memory, magnetic storage, optical storage, or another memory device). The one or more memory devices may include a memory device storing instructions to be executed by the one or more processors.

Compactor machine 100 may include a wired (e.g., CAN, fiber optic, ethernet etc.) or wireless (e.g., Bluetooth, cellular, radio etc.) connection between the control system and system 105. Therefore, based on a determined compaction level and an acceptable range of compaction (and/or other variables described below with respect to FIGS. 2A-2F), the control system may modify operating parameter(s) to ensure an acceptable compaction range or threshold is reached. In some embodiments, the control system may store instructions commanding compactor machine 100 to adjust certain operating parameters based on determined compaction level(s) and one or more variables. In some embodiments, these instructions may be programmed by a user based on a desired response to one or more variables.

Figure 2A:
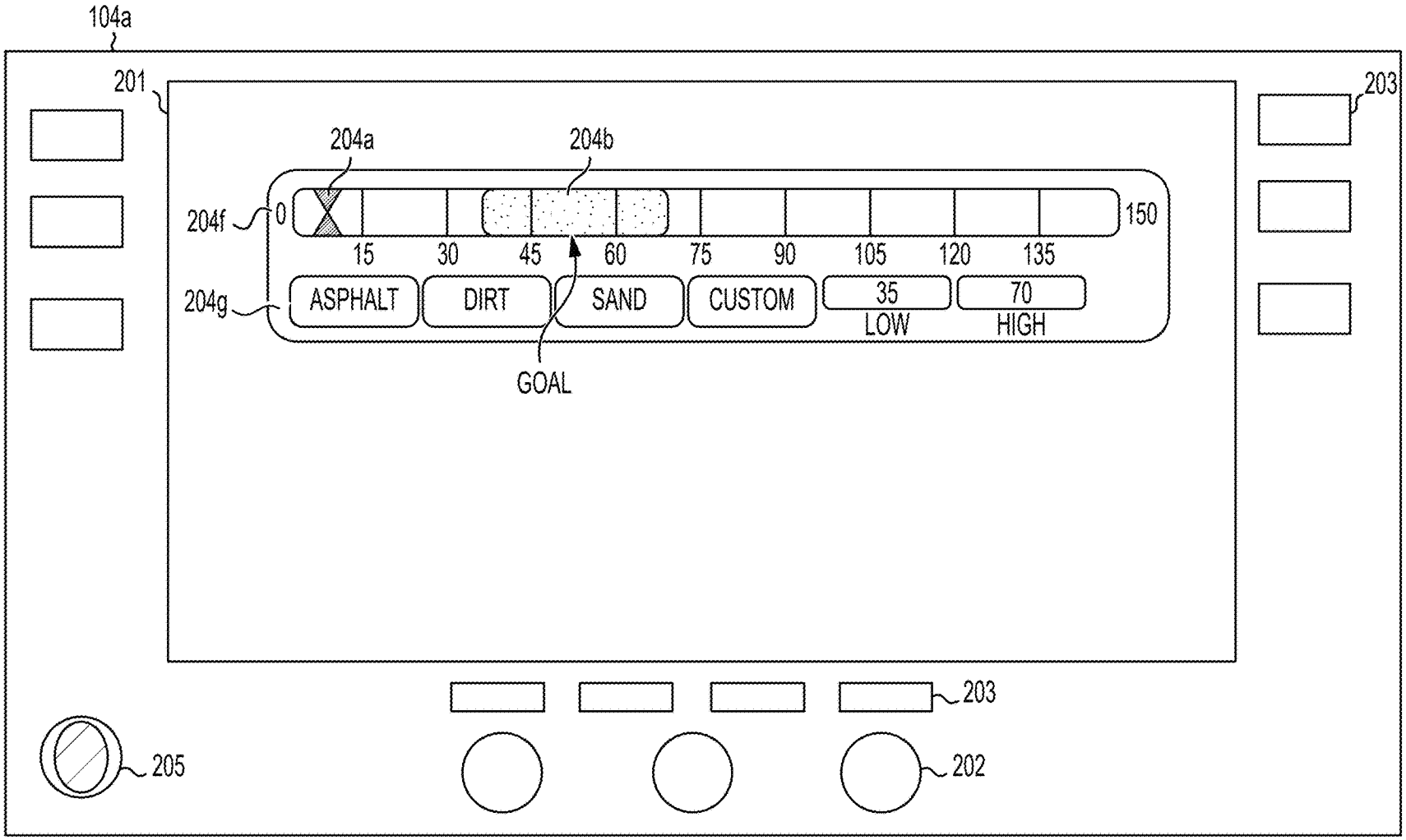
FIGS. 2A-2F are exemplary illustrations of a display device for use with the machine of FIG. 1.

FIG. 2A illustrates an exemplary display device. For example, FIG. 2A may illustrate first display device 104(*a*). As shown, display device 104(*a*) may include one or more buttons 203, knobs 202, and/or other user input devices (e.g., levers, sliders etc.), allowing a user to navigate display device 104(*a*). Display device 104(*a*) may further include one or more display screens 201 such as an LCD display screen, an LED display screen, a touchscreen display, a projected display, a holographic display, and/or an augmented reality display (such as a heads-up display device or a head-mounted device). Display screen 201 may include one or more display elements, such as user output element 204*f* (e.g., a colored gauge bar) and user input element 204*g*. Display device 104(*a*) may be configured to receive compaction setting information on user input element 204*g* and/or another user input device.

Compaction setting information may refer to any information needed by system 105 to determine an acceptable range of compaction. For example, as shown, display device 104(*a*) may allow a user to select one or more earthen material options, such as "asphalt", "dirt", and/or "sand." It should be understood that the types of earthen materials options illustrated in FIG. 2A and described above are exemplary and nonlimiting and that display device 104(*a*) may allow a user to configure or otherwise select additional earthen materials (e.g., pre-set earthen materials) and their associated compaction levels. System 105 may store an acceptable range of compaction levels for each material option selection. In some embodiments, display device 104(*a*) may further allow a user to set or select (e.g., from a plurality of options) a depth of the earthen material to be installed (e.g., a depth of asphalt). System 105 may store an acceptable range of compaction levels for the depth of the selected earthen material. In some embodiments one or more selectable options and/or pre-stored acceptable ranges may be manually input to system 105 via one or more user input devices (e.g. on display device 104(*a*) or separate from display device 104(*a*)). Therefore, compactor machine 100 may be easily configured for the needs of each project site.

In some embodiments, a user may set an acceptable range of compaction levels during the compaction process. For example, a user may select an option of "custom" on input element 204*g* and then proceed to set an acceptable range of compaction levels (e.g., via a low and high value) or an acceptable threshold for compaction. The user may set the acceptable range or threshold via user input device(s) located on display device 104(*a*) or a separate user input device. For example, a user input device may include a keypad, up/down arrow(s), knob(s), and/or other user interface element(s).

In some embodiments, the set acceptable range of compaction levels or acceptable threshold may be represented by compaction meter value(s) (CMV) within a range of 0-150, while in other embodiments they may be represented by a machine drive power value (MDP). In some embodiments, display device 104(*a*) may include a gauge with a range of 0-150 and lines, dashes, dots, and/or numbers may allow an operator to understand a set acceptable range and/or threshold within the total gauge range of 0-150. It should be understood that the numerical range 0-150 is exemplary and any other numerical range may be used and displayed on display device 104(*a*).

User output element 204*f* may include information on the determined compaction level and the acceptable range (and/or threshold) of compaction. For example, as illustrated, output element 204*f* shows the determined compaction level using an indicator 204*a*. As discussed above, the compaction level may be determined by system 105 based on inputs received from one or more sensors of compactor machine 100 and/or one or more inputs provided by the operator. Indicator 204*a* may take the form of a line, arrow, dot, compaction level value, and/or any other symbol. Further, as illustrated, output element 204*f* shows the acceptable range of compaction levels using range indicator 204*b*. Acceptable range indicator 204*b* may take the form of a square, rounded-square, ellipse, highlighted gauge section (e.g., highlighted green), and/or any other indicator. Therefore, an operator can visualize the determined compaction value in relation to the acceptable range and determine next steps. For example, an operator may choose to stop compaction in response to noticing the determined compaction level is within the acceptable range.

Display device 104(*a*) may further include a speaker 205. System 105 may store compaction instructions, sound types, and/or sound levels to be provided by speaker 205. In some embodiments, system 105 may provide compaction instructions and/or associated sounds in response to one or more user inputs. For example, in some embodiments, display device 104(*a*) may include a user input device (e.g., button or interface element (not shown)) configured to receive a user selection to enable or disable all compaction instructions and associated sounds. In some embodiments, display device 104(*a*) may include a user input device configured to receive operator selection(s) indicating which type of instructions and/or sounds to enable. For example, a user input device may allow a user to enable certain types of visible compaction instructions (e.g., words and/or symbols displayed on display screen 201) and/or audible compaction instructions (e.g., verbal instructions provided through speaker 205), such as instructions indicating to an operator to continue compacting, to perform a set number of passes with compactor machine 100, to continue compacting for a set period of time, and/or to stop compacting. In some embodiments, speaker 205 may be capable of receiving and storing audio as well as playing back audio.

As another example, a user input device may allow a user to enable sounds indicating compaction progress. For example, a user input device may allow a user to select one or more types of sound to be provided (e.g., beep(s), buzz(es), bell ring(s), alarm(s) etc.), compaction level(s) that trigger associated sounds (e.g., within a proximity (e.g., 10%) of an acceptable range, within an acceptable range, exceeding a threshold, outside an acceptable range etc.), and/or set sound level(s) (e.g., a max sound level, a range of sounds to be provided etc.). While speaker 205 is shown as part of display device 104(*a*) it may also be separate from display device 104(*a*). For example, one or more speaker(s) 104(*a*) may be mounted anywhere inside cabin 102 that allows an operator to hear instructions or sounds.

Figure 2B:
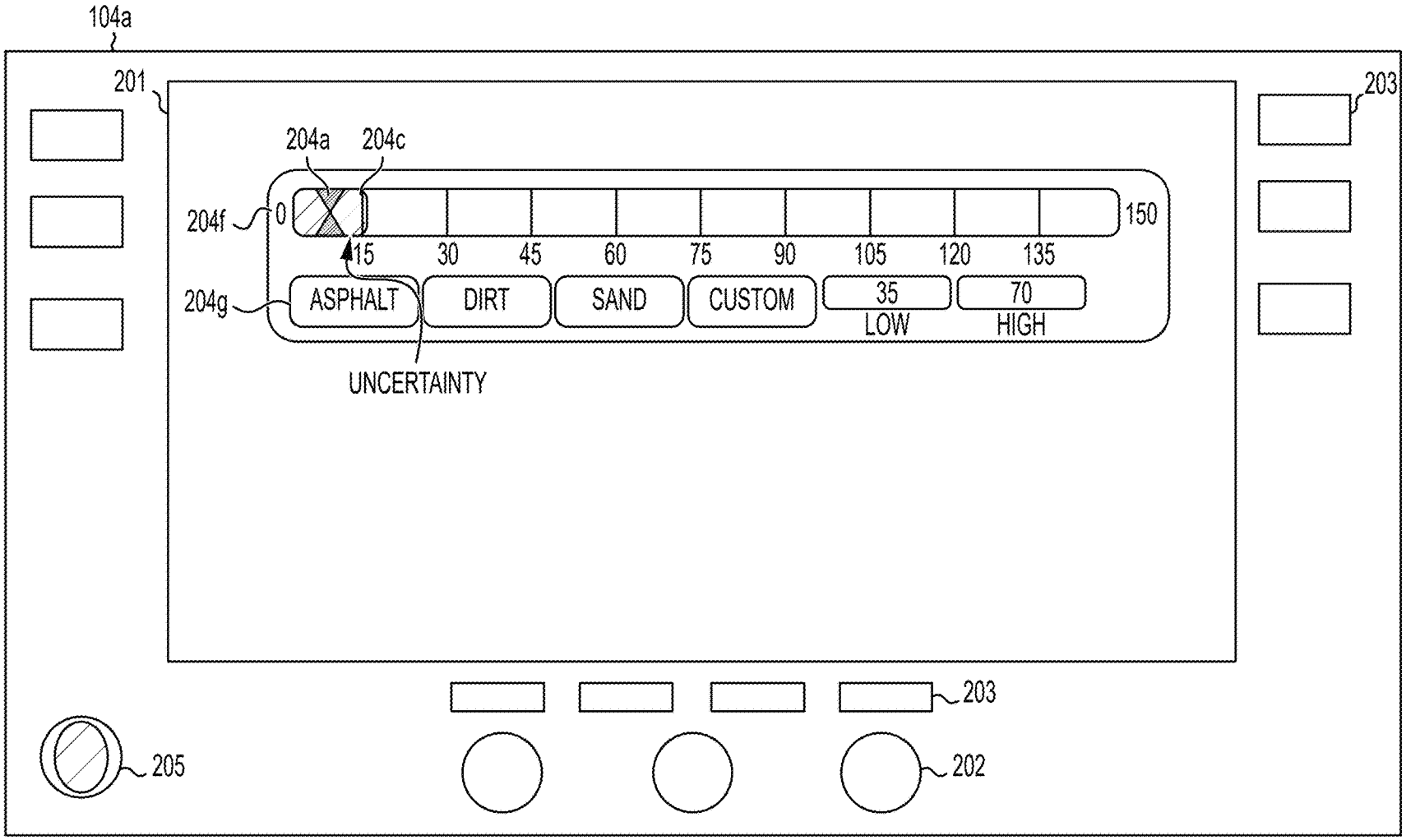

FIG. 2B illustrates another exemplary display device, such as display device 104(*a*). In some embodiments, user output element 204*f* may include information on an uncertainty of a determined compaction level. System 105 may store information related to an uncertainty of a determined compaction level. In some embodiments, an uncertainty range may be manually input to display device 104(*a*) via one or more user input devices. In some embodiments, an uncertainty range may be automatically determined by system 105. For example, system 105 may store lookup tables, models, and/or algorithms to update an uncertainty based on terrain conditions, earthen material, weather, sensor functionality (e.g., whether a sensor is experiencing a fault, whether a reading is provided by a sensor, whether the sensed value is within a range of expected values, calibration error(s), noise associated with measurements etc.), model uncertainty and/or any other variables that may affect an accuracy of the determined compaction level. Output element 204*f* may display the uncertainty of the compaction level using an uncertainty range indicator 204*c*. Uncertainty range indicator 204*c* may take the form of a square, rounded-square, ellipse, highlighted gauge section (e.g., highlighted a certain color), text value, and/or any other indicator. Therefore, an operator may be able to easily visualize the uncertainty associated with the compaction level. For example, an operator may choose to continue compacting in response to a lower portion of the uncertainty range being below an acceptable range value and/or below a threshold compaction value.

Figure 2C:
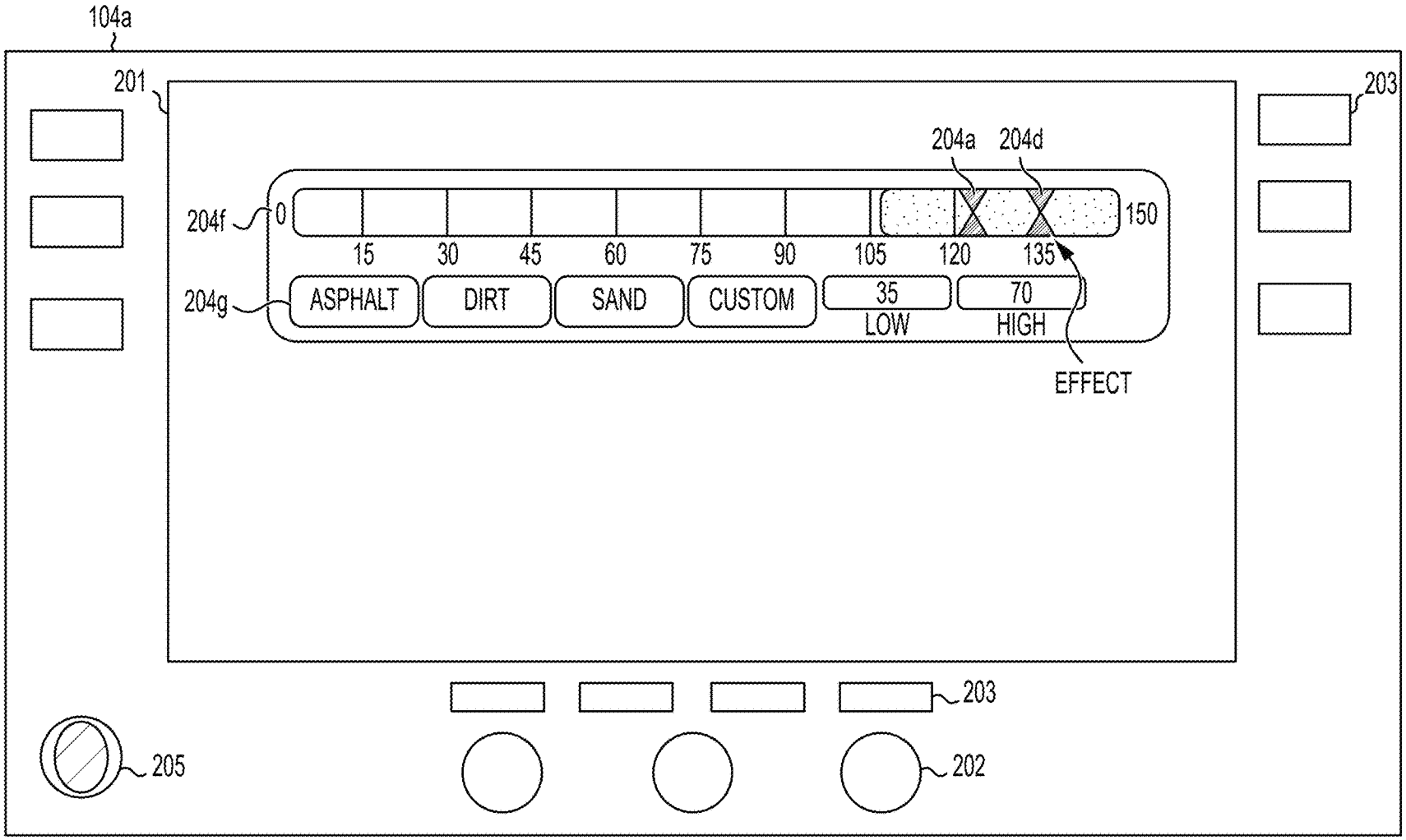

FIG. 2C illustrates another exemplary display device, such as display device 104(*a*). In some embodiments, user output element 204*f* may include information on an impact of an additional amount of compaction. System 105 may store information related to the impact of an amount of compaction time and/or set number of passes by compactor machine 100. In some embodiments, an impact of a compaction time and/or number of passes may be manually input to the system 105 (e.g., via one or more user input devices). In some embodiments, an impact of a compaction time and/or number of passes may be automatically determined by system 105. For example, system 105 may update an impact of compaction time and/or set number of passes based on terrain conditions, earthen material, weather, and/or any other variables that may impact the effectiveness of compactor machine 100. System 105 may determine and/or update an impact of compaction by tracking an impact of compaction time and/or set number of passes on the measured compaction level (e.g., an average change in compaction level based on a set time or number of passes).

Output element 204*f* may display the effect of additional compaction time and/or number of passes (e.g., 1 pass over an area) using results indicator 204*d*. Results indicator 204*d* may take the form of a line, arrow, dot, compaction level value, section of the gauge whose compaction values will be exceeded (e.g., indicated by a square, rounded-square, ellipse, highlighted gauge section), and/or any other indicator. Therefore, an operator may be able to visualize the impact of additional compaction time and/or number of passes. For example, an operator may choose to stop compaction if an additional pass would overshoot an acceptable compaction range and/or a threshold compaction value.

Figure 2D:
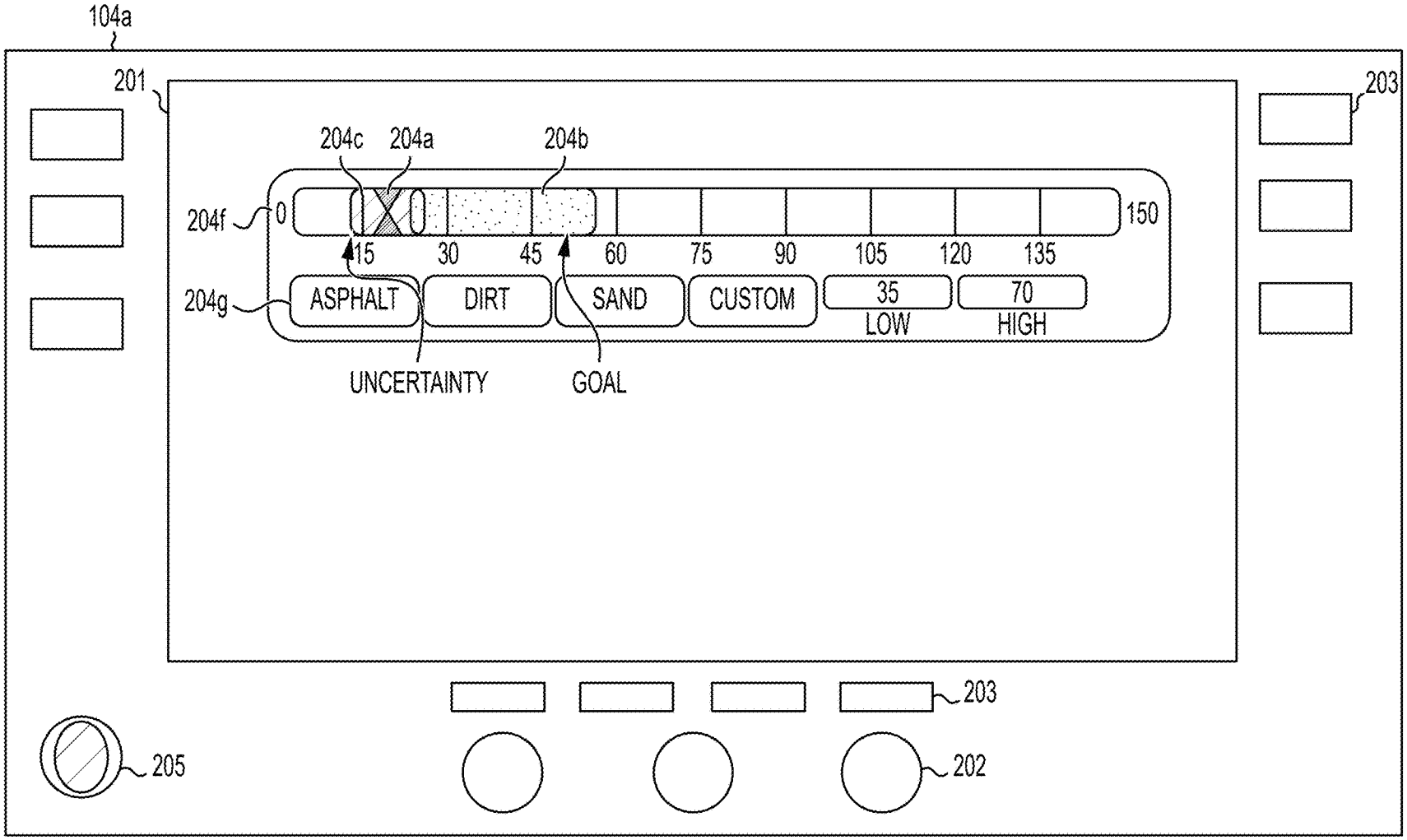
Figure 2E:
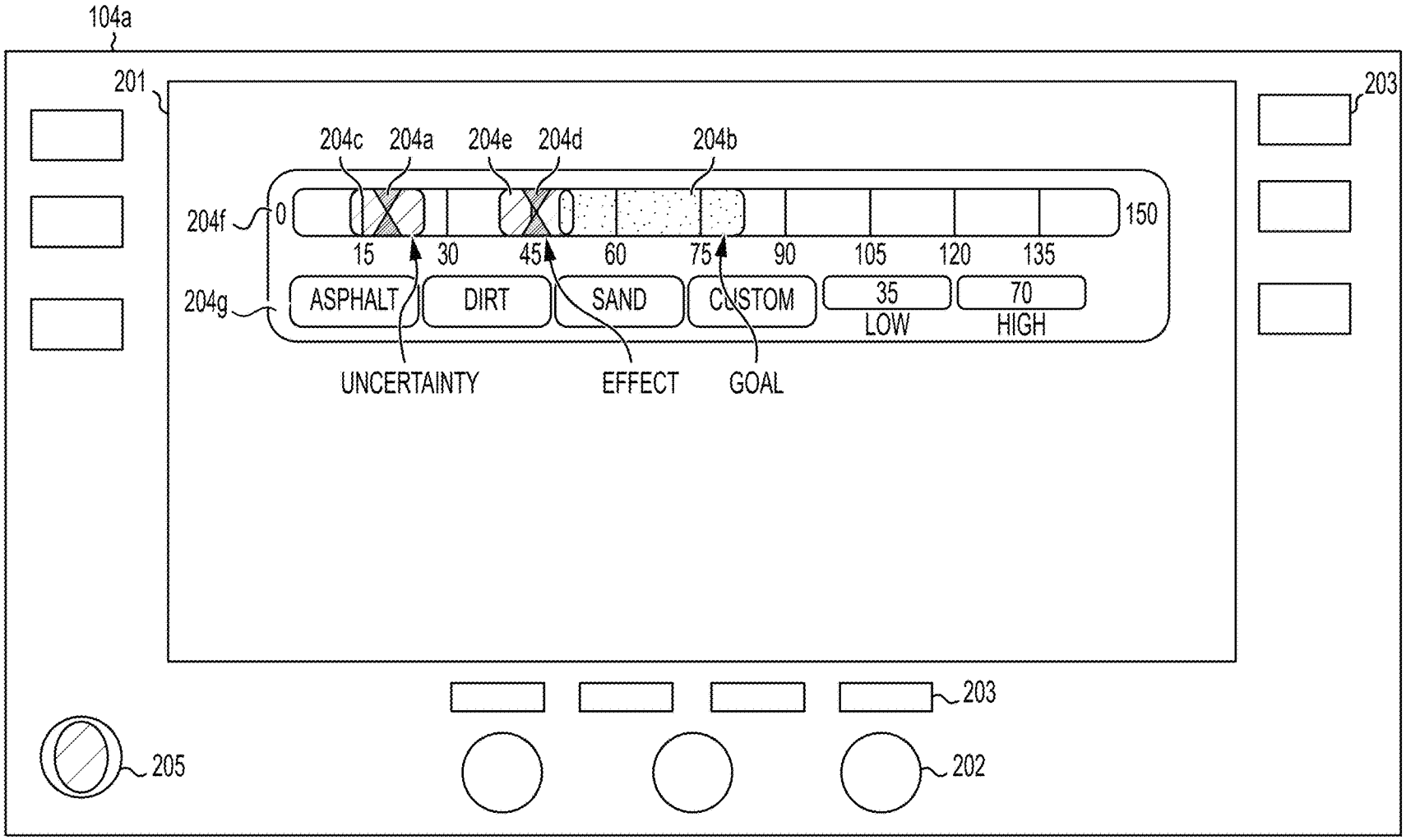

In some embodiments, one or more of the different display elements described above with respect to FIGS. 2A-2C may be combined and included on the user output element 204*f*. For example, as shown in FIG. 2D, user output element 204*f* may include determined compaction level indicator 204*a*, uncertainty range indicator 204*c*, and acceptable range indicator 204*b*. Therefore, an operator may be able to determine what portion of a range of possible compaction values (if any) falls within the acceptable compaction range. For example, as shown in FIG. 2E, user output element 204*f* may include determined compaction level indicator 204*a*, uncertainty range indicator 204*c* associated with a determined compaction level, results indicator 204*d*, uncertainty range indicator 204*e* associated with a resulting compaction level, and acceptable range indicator 204*b*. Therefore, an operator may be able determine what portion of a resulting range of possible compaction values (if any) falls within the acceptable compaction range.

Figure 2F:
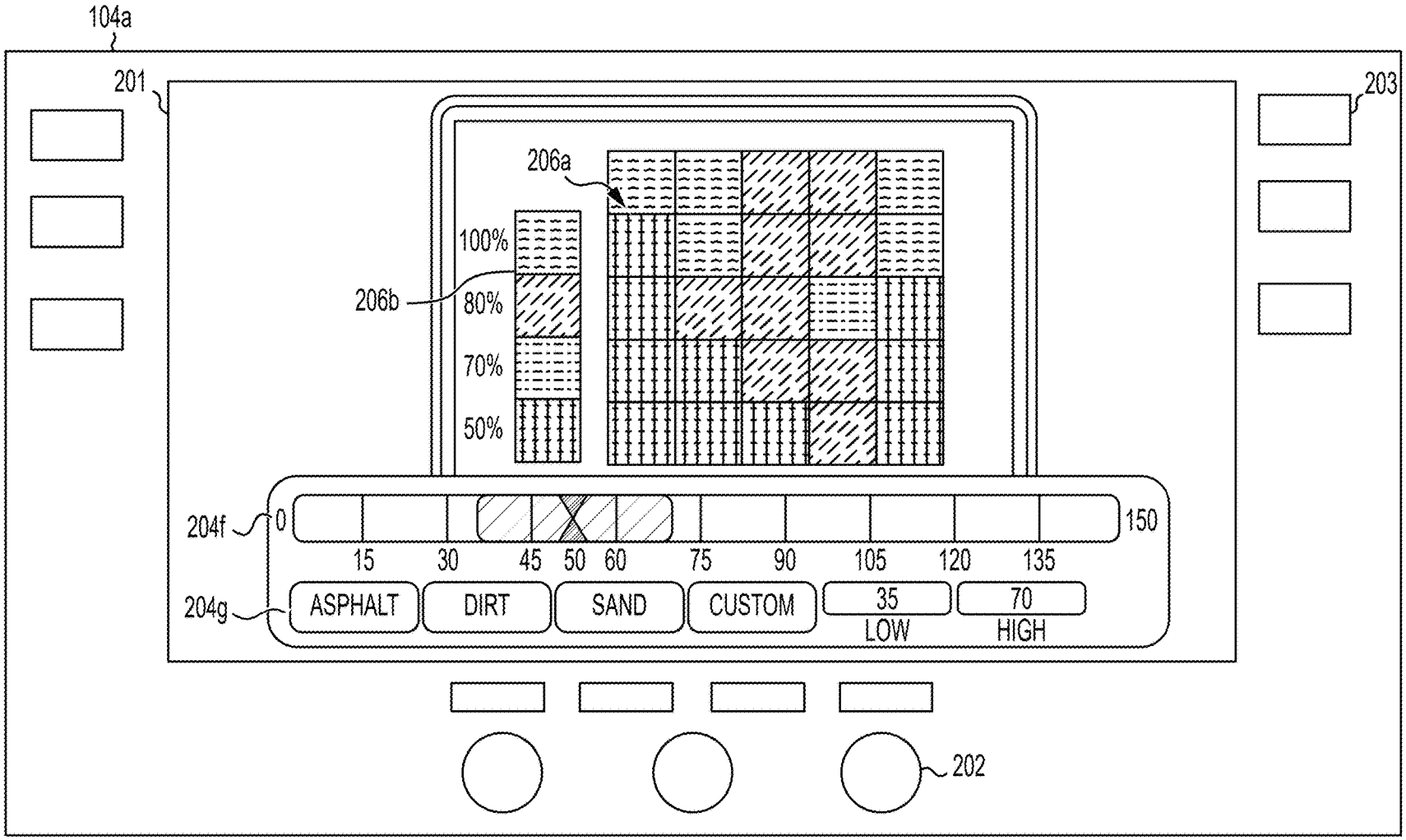

FIG. 2F illustrates another exemplary display device, such as display device 104(*a*). As shown in FIG. 2F, in addition to and/or in lieu of user output element 204*f*, display screen 201 may include user output element(s) 206(*a*) and 206(*b*). Work area element 206(*a*) may detail a current level of compaction for each section of a work area and/or a location of compactor machine 100. For example, system 105 may update a schematic of the work area based on determined compaction level(s), location measurements (e.g., measurements from GPS sensor 103(*b*)), and/or other compaction information. In some embodiments, key element 206(*b*) may include a key to provide information on work area 206(*a*). For example, key element 206(*b*) may show that certain colors, hatching, highlighting, and/or other indicators correspond to a certain amount of compaction. In some embodiments, the level of compaction may be in relation to a threshold compaction value (e.g., 100% indicates the threshold value is met). In some embodiments, the level of compaction may be in relation to an acceptable range of compaction (e.g., 100% indicates the level of compaction is within the acceptable range). In some embodiments, user output element 204*f* may also be included on display screen 201. For example, user output element 204*f* may provide compaction information for a portion of the work area selected by the user (e.g., via click or press on a certain area of the work area schematic) and/or a portion of the work area currently being traversed by compactor machine 100. In some embodiments, user input element 204*g* may be included on the display screen 201 to allow a user to set an acceptable compaction range for the work area. For example, in some embodiments, a user may set an acceptable compaction range for the entire work area. In some embodiments, a user may select different portions of the work area (e.g., via click or press on work area element 206(*a*)) and then set an acceptable compaction range for the selected portion of the work area.

Figure 3A:
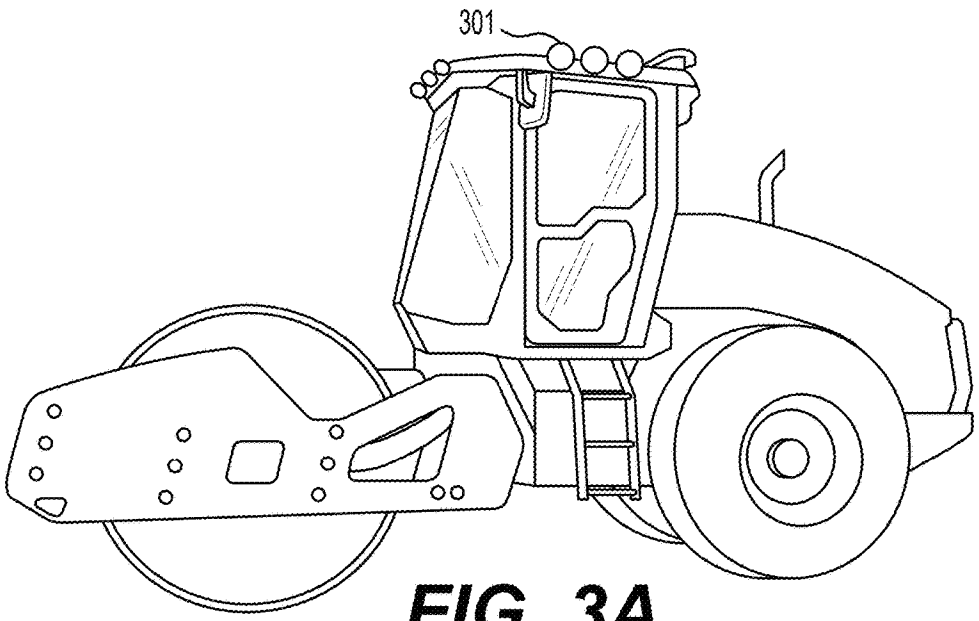
FIGS. 3A-3B are exemplary illustrations of another display device for use with the machine of FIG. 1.

FIG. 3A illustrates an exemplary display device, such as second display device 104(*b*). As shown, second display device 104(*b*) may include light(s) 301. In some embodiments, light(s) 301 may include a plurality of lights with each light configured to display a different color, while in other embodiments light(s) 301 may include a single light configured to display different colors. In some embodiments, light(s) 301 may be mounted on the four exterior sides of cabin 102, while in other embodiments light(s) 301 may be mounted on one or two exterior sides of cabin 102. System 105 may be configured to adjust the light color of light(s) 301 based on a determined compaction level. For example, in some embodiments, system 105 may turn on a green light or set a light to its green setting in response to determining the compaction level has exceeded a threshold and/or is within an acceptable range (e.g., as set by a user). In some embodiments, system 105 may turn on a yellow light or set a light to its yellow setting in response to determining the compaction level has not met a threshold and/or is not yet within an acceptable range. In some embodiments, system 105 may turn on a red light or set a light to its red setting in response to determining a malfunction with compactor machine 100. For example, system 105 may turn on a red light or set a light to its red setting based on detecting a portion of a compactor machine 100 is detaching (e.g., roller or transmission), there is an electrical fault, the engine is overheating, there is an oil leakage, and/or a vibratory component is malfunctioning. In other embodiments, different color schemes may be used to represent whether a compaction level is acceptable and/or to provide a warning of a malfunction. In some embodiments, light(s) 301 may be configured to have a plurality of intermediate light colors between unacceptable compaction and acceptable compaction. For example, light(s) 301 may gradually transition from yellow to green based on a level of compaction approaching and reaching a threshold value or an acceptable range. In some embodiments, light(s) 301 may be configured to display a different color based on system 105 determining a compaction level has exceeded an acceptable range.

Figure 3B:
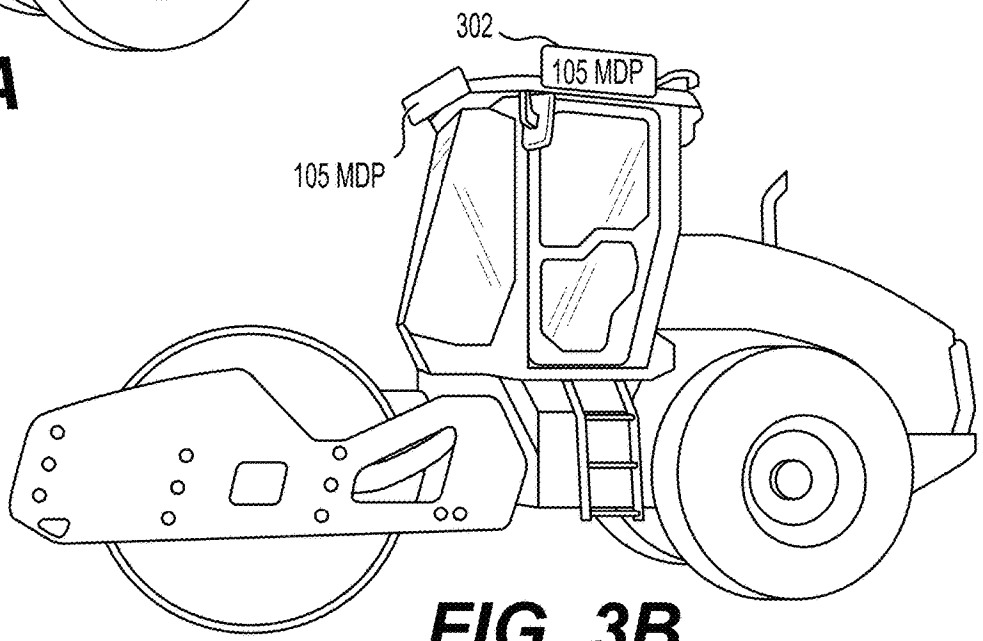

FIG. 3B illustrates an exemplary display device, such as second display device 104(*b*). In some embodiments, display device 302 may be mounted on the four exterior sides of cabin 102, while in other embodiments display device 302 may be mounted on one or two exterior sides of the cabin 102. In some embodiments, display device 302 may provide text describing a compaction process. For example, display device 302 may provide a determined value of compaction and/or a compaction percentage (e.g., relative to a threshold value or acceptable range). In some embodiments, display device 302 may provide additional information as well. For example, display device 302 may flash or change color upon the determined compaction level reaching a threshold value or an acceptable range. In some embodiments, display device 302 may indicate a malfunction with compactor machine 100. In some embodiment, display device 302 may provide a warning through text and/or colors. In some embodiments, the warning may detail the type of malfunction being experienced by the compactor machine 100.

Figure 4:
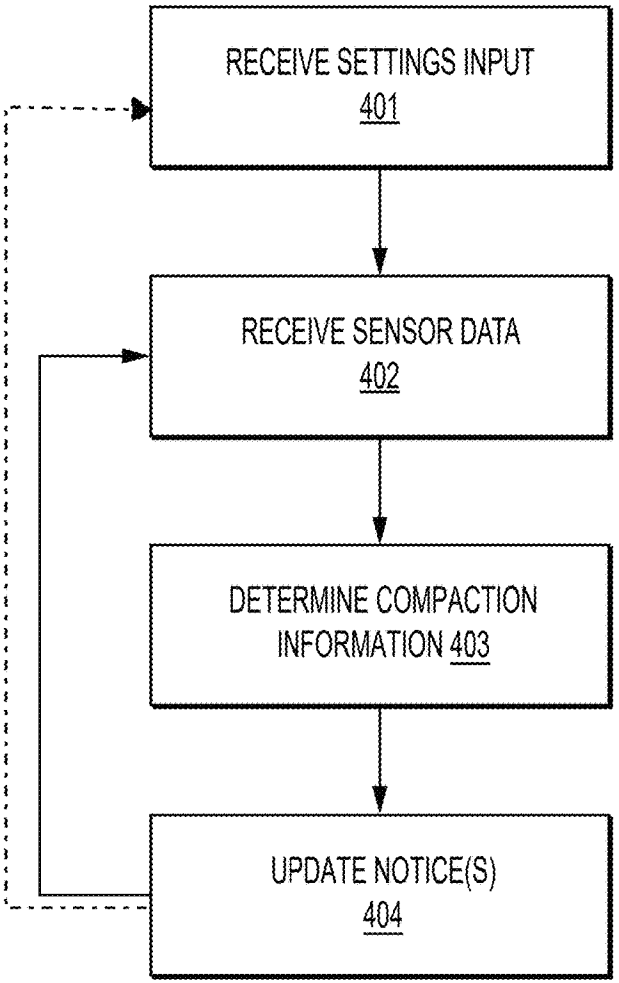
FIG. 4 is an exemplary method for compaction monitoring.

FIG. 4 is an exemplary method 400 for compaction monitoring and providing notices (e.g., via a display device). The process illustrated may be performed by system 105. For example, system 105 may store instructions in a memory device to execute the process via one or more processors of system 105. At step 401, system 105 may receive setting input information. For example, system 105 may receive an acceptable compaction range via input on first display device 104(*a*) and/or other user setting information described above.

At step 402, system 105 may receive sensor data associated with a compaction level of earthen material. For example, system 105 may receive sensor data from one or more of sensors 103(*a*)-103(*d*) to determine a compaction level. In some embodiments, system 105 may further receive information from one or more sensors and/or a vehicle control system to determine a level of uncertainty associated with the compaction level. In some embodiments, system 105 may further receive sensor information on conditions that may affect an impact of a set number of passes and/or compaction time, as described above. For example, system 105 may receive positioning information (e.g., GPS data) and timing information to track an impact of a compaction time and/or set number of passes on the compaction level (e.g., an average change in compaction level based on a set time or number of passes).

At step 403, system 105 may determine compaction information (e.g., a compaction level) based on the sensor data. For example, as described above, system 105 may include one or more lookup tables, models, and/or algorithms to determine a compaction level based on the sensor data. In some embodiments, system 105 may further reference one or more lookup tables, models, and/or algorithms to determine an uncertainty of the determined compaction level based on terrain conditions, earthen material, weather, sensor functionality, model uncertainty and/or any other variables that may affect an accuracy of the determined compaction level. In some embodiments, system 105 may determine an impact of a set number of passes and/or compaction time based on terrain conditions, earthen material, weather, any other variables that may impact the effectiveness of compactor machine 100, and/or a tracked impact of compaction.

At step 404, system 105 may update notices (e.g., display and/or speaker information) based on the determined compaction level. For example, a display may be updated to show the determined compaction level (e.g., in relation to a set acceptable range) and/or other associated compaction information. For example, first display device 104(*a*) may be updated to illustrate any of the information described above with respect to FIGS. 2A-2F. Additionally or alternatively, for example, a second display device 104(*b*) may be updated to illustrate any of the information described above with respect to FIGS. 3A-3B.

In some embodiments, system 105 may further provide compaction instructions and/or associated sounds based on the relationship between the determined compaction level and an acceptable compaction range. For example, system 105 may instruct an operator (e.g., via speaker 205) to continue compacting when the determined compaction level is below an acceptable range. System 105 may instruct an operator to perform a set number of passes and/or continue compacting for a set time based on predicting the additional compaction will bring the compaction level into an acceptable range (and/or exceed a threshold). System 105 may instruct an operator to stop compaction upon determining the compaction level is within an acceptable range or has met a set threshold (e.g., midpoint of the range), and/or predicting that a set number of passes or additional compaction time will cause the compaction level to exceed an acceptable range.

System 105 may additionally or alternatively provide audible cues to inform an operator on the compaction progress. For example, in some embodiments, system 105 may provide sound(s) (e.g., beep(s), buzz(es), bell ring(s), alarm(s) etc.) when the determined compaction level is below an acceptable range or threshold. In some embodiments, system 105 may provide sound(s) (e.g., beep(s), buzz(es), bell ring(s), alarm(s) etc.) upon determining the compaction level is within an acceptable range or has met a set threshold (e.g., midpoint of the range), and/or predicting that a set number of passes or additional compaction time will cause the compaction level to exceed an acceptable range. In some embodiments, different sound types may be provided based on the compaction level. For example, a first sound may be provided to instruct an operator to continue compacting (e.g., a beep) and a second sound may be provided to instruct an operator to stop compacting (e.g., an alarm). In some embodiments, different sound levels may be provided to indicate the proximity of the compaction level to an acceptable range or threshold. For example, system 105 may increase the level of a periodic sound (e.g., beep(s), buzz(es), bell ring(s), alarm(s) etc.) as the compaction level approaches an acceptable range or threshold.

In some embodiments, based on the provided notices, an operator of compactor machine 100 may adjust operating parameter(s) of compactor machine 100 via one or more input devices. For example, an operator may adjust a trajectory of compactor machine 100, a speed of compactor machine 100, a speed of roller component 101, a vibration frequency of roller component 101, and/or an amplitude of roller component 101 to increase or decrease a compaction provided in one or more sections of a work area. In some embodiments, a control system may automatically adjust an operating parameter in response to a determined compaction level and one or more determined variables (e.g., an acceptable range, uncertainty range(s), effect(s) of additional compaction, and/or determined compaction level(s) in certain sections of a work area).

After providing the above notices, the system 105 may receive additional sensor data at step 402 and perform steps 403-404 again. Therefore, notifications may be updated as the compaction progresses and compaction can be appropriately monitored. In some embodiments, new sensor data may be received on a continuous basis, while in other embodiments new sensor data may be received at set time interval.

Further, as indicated by the dashed line, system 105 may continue to monitor whether there have been any changes to the setting information. Therefore, the relationship between the determined compaction level and the setting information (e.g., an acceptable compaction range) can be appropriately displayed.

INDUSTRIAL APPLICABILITY

The disclosed compaction monitoring system and associated display(s) may allow an operator to set a desired compaction range and have an understanding of how the determined compaction level relates to the set range as compaction progresses. For example, the disclosed compaction monitoring system allows for a user to easily select a desired compaction range based on a type of material or create a custom range (e.g., in response to project requirements). The display(s) provide an operator a relationship between the determined compaction level and the desired compaction range. Therefore, an operator can easily understand the relationship between a compaction level and a desired compaction range and under-compaction or over-compaction can be avoided.

Further, the disclosed compaction monitoring system and associated display(s) allow an operator to get a better understanding of additional aspects of the compaction process. The disclosed display(s) may provide uncertainty (ties) associated with a compaction level. For example, display(s) may provide an operator an uncertainty of a determined compaction level. Therefore, an operator can easily understand the uncertainty associated with a compaction level and may choose to perform additional compaction to ensure a desired level is reached. Further, display(s) may provide a projected effect of an additional amount of compaction time and/or number of passes will have on the compaction level. Therefore, an operator can easily understand the uncertainty associated with a compaction level and may choose to perform additional compaction (e.g., if a projection shows a desired level will be reached) or avoid additional compaction (e.g., if a projection shows a desired level will be over-shot).

It is to be noted that when some exemplary embodiments are described in this disclosure as exhibiting a feature or characteristic, some or all the other exemplary embodiments described in this disclosure may also exhibit that same feature or characteristic. It will be apparent to those skilled in the art that various modifications and variations can be made to the disclosed compaction monitoring system and associated display(s). Other embodiments will be apparent to those skilled in the art from consideration of the specification and practice of the disclosed compaction monitoring system and associated display(s). For example, the displayed content may be presented in different styles, different positioning, and/or different sizing without deviating from the scope of the invention. It is intended that the specification and examples be considered as exemplary only, with a true scope being indicated by the following claims and their equivalents.

What is claimed is:

1. A system for controlling compaction operations, comprising at least one processor configured to:

receive, from one or more sensors associated with a machine performing compaction operations on earthen materials, sensor data indicating a compaction level;

determine, during the compaction operations, a compaction level of the earthen materials based on the received sensor data;

receive, via an input device on the machine, a first user input indicating an acceptable compaction range;

display, via a gauge on a display screen, the determined compaction level and the acceptable compaction range;

receive a second user input associated with at least one operating parameter of the machine in response to the determined compaction level being outside the acceptable compaction range; and adjust the at least one operating parameter based on the received second user input.

2. The system of claim 1, further configured to:

store an acceptable compaction range for each of a plurality of earthen material types, wherein the first user input includes selection of an earthen material type from the plurality of earthen material types, and wherein displaying the acceptable range comprises displaying the stored respective acceptable range associated with the selected earthen material type.

3. The system of claim 1, further configured to:

store an acceptable compaction range for each of a plurality of depths of compaction, wherein the first user input includes setting a depth of compaction, and wherein displaying the acceptable range comprises displaying the stored respective acceptable range associated with the set depth of compaction.

4. The system of claim 1, further configured to:

render selectable options for a plurality of earthen material options on a screen, wherein the first user input comprises selecting an option from the rendered selectable options; and wherein displaying the acceptable range comprises displaying an acceptable range associated with the selected option.

5. The system of claim 1, further configured to:

render a first user input element to accept a low value of an acceptable compaction range and a second user input element to accept a high value of an acceptable compaction range, wherein the first user input includes providing the low value and the high value, and wherein displaying the acceptable range comprises displaying an acceptable range associated with the low value and the high value.

6. The system of claim 1, further configured to display, via the gauge, an uncertainty associated with the determined compaction level.

7. The system of claim 1, further configured to display, via the gauge, an effect of an additional amount of compaction.

8. The system of claim 1, further configured to:

provide an audible notice based on the determined compaction level, wherein the audible notice indicates at least one of: a proximity to the acceptable compaction range, whether the acceptable compaction range has been reached, or whether the acceptable compaction range has been exceeded.

9. The system of claim 1, further configured to adjust a lighting display based on the determined compaction level, where adjusting the lighting display comprises:

displaying a first light color based on the determined compaction level being below the acceptable compaction range; and displaying a second light color based on the determined compaction level being within the acceptable compaction range.

10. The system of claim 9, further configured to display a third color based on detecting an issue with a component of a compactor.

11. A method for controlling compaction operations, comprising:

receiving, from one or more sensors associated with a machine performing compaction operations on earthen materials, sensor data indicating a compaction level;

determining, during the compaction operations, a compaction level of the earthen materials based on the received sensor data;

receiving, via an input device on the machine, a first user input indicating an acceptable compaction range;

displaying, via a gauge on a display screen, the determined compaction level and the acceptable compaction range;

receiving a second user input associated with at least one operating parameter of the machine in response to the determined compaction level being outside the acceptable compaction range; and adjusting the at least one operating parameter based on the received second user input.

12. The method of claim 11, further comprising:

storing an acceptable compaction range for each of a plurality of earthen material types, wherein the first user input includes selection of an earthen material type from the plurality of earthen material types, and wherein displaying the acceptable range comprises displaying the stored respective acceptable range associated with the selected earthen material type.

13. The method of claim 11, further comprising:

storing an acceptable compaction range for each of a plurality of depths of compaction, wherein the first user input includes setting a depth of compaction, and wherein displaying the acceptable range comprises displaying the stored respective acceptable range associated with the set depth of compaction.

14. The method of claim 11, further comprising:

rendering selectable options for a plurality of earthen material options on a screen, wherein the first user input comprises selecting an option from the rendered selectable options; and wherein displaying the acceptable range comprises displaying an acceptable range associated with the selected option.

15. The method of claim 11, further comprising:

rendering a first user input element to accept a low value of an acceptable compaction range and a second user input element to accept a high value of an acceptable compaction range, wherein the first user input includes providing the low value and the high value, and wherein displaying the acceptable range comprises displaying an acceptable range associated with the low value and the high value.

16. The method of claim 11, further comprising:

displaying, via the gauge, an uncertainty associated with the determined compaction level.

17. The method of claim 11, further comprising:

displaying, via the gauge, an effect of an additional amount of compaction.

18. The method of claim 11, further comprising:

providing an audible notice based on the determined compaction level, wherein the audible notice indicates at least one of: a proximity to the acceptable compaction range, whether the acceptable compaction range has been reached, or whether the acceptable compaction range has been exceeded.

19. The method of claim 11, further comprising:

adjusting a lighting display based on the determined compaction level, wherein adjusting the lighting display comprises:

displaying a first light color based on the determined compaction level being below the acceptable compaction range; and displaying a second light color based on the determined compaction level being within the acceptable compaction range.

20. The method of claim 11, further comprising:

displaying a third color based on detecting an issue with a component of a compactor.

21. A compactor machine, comprising:

a chassis;

a set of wheels connected to the chassis;

an operator cabin supported by the chassis; and a system configured to:

receive, from one or more sensors associated with the compactor machine, sensor data indicating a compaction level;

determine, during compaction operations, a compaction level of the earthen materials based on the received sensor data;

receive, via an input device on the compactor machine, a first user input indicating an acceptable compaction range;

display, via a gauge on a display screen, the determined compaction level and the acceptable compaction range;

receive a second user input associated with at least one operating parameter of the machine in response to the determined compaction level being outside the acceptable compaction range; and adjust the at least one operating parameter based on the received second user input.

* * * * *